US005127647A

United States Patent [19]

Wilkinson

[11] Patent Number: 5,127,647

[45] Date of Patent: Jul. 7, 1992

[54] PORTABLE, ADJUSTABLE EXERCISE STEP/BENCH

[76] Inventor: William T. Wilkinson, 1717 Town Pilot Rd., Chesapeake City, Md. 21915

[21] Appl. No.: 672,429

[22] Filed: Mar. 20, 1991

Related U.S. Application Data

[63] Continuation-in-part of Ser. No. 533,004, Jun. 4, 1990, abandoned.

[51] Int. Cl.[5] ..... A63B 17/00; A47B 9/00; F16M 11/04

[52] U.S. Cl. ..... 472/52; 108/12; 248/188; 248/911; 403/3

[58] Field of Search ..... 297/175, 423, 424, 438, 297/439, 445, 461; 108/11, 12, 19, 43, 49, 155-157, 159, 144, 111; 248/188, 188.2, 188.8, 911; 403/3; 211/207, 208; 272/70, 144, DIG. 4, 65; 182/46, 242

[56] References Cited

U.S. PATENT DOCUMENTS

| | | | |
|---|---|---|---|
| Re. 28,293 | 1/1975 | Bustos | 108/144 |
| 1,764,226 | 6/1930 | Rennack | 108/157 X |
| 1,838,352 | 12/1931 | Anderson | 108/144 X |
| 1,891,393 | 12/1932 | Oppenländer | 108/111 |
| 2,026,011 | 12/1935 | Wright | 108/49 |
| 2,339,075 | 1/1944 | Hollnagel . | |
| 2,529,940 | 11/1950 | Higley | 108/144 |
| 2,722,970 | 11/1955 | Stechmann | 248/188.2 |
| 2,764,412 | 9/1956 | Dunham . | |
| 2,940,806 | 6/1960 | Fields | 108/144 |
| 3,123,935 | 3/1964 | Williams | 108/144 |
| 3,604,371 | 9/1971 | Cavalucci | 108/156 |
| 3,687,092 | 8/1972 | Manning | 108/156 |
| 4,011,821 | 3/1977 | Neal | 248/188 X |
| 4,225,131 | 9/1980 | Sidlinger et al. | 272/65 X |
| 4,330,151 | 5/1982 | Healey | 297/157 |
| 4,333,638 | 6/1982 | Gillotti | 269/322 |
| 4,340,218 | 7/1982 | Wilkinson | 272/136 |
| 4,561,652 | 12/1985 | Wilkinson | 272/119 |
| 4,645,196 | 2/1987 | Christie | 272/123 |
| 4,648,593 | 3/1987 | Wilkinson | 272/70 |
| 4,659,075 | 4/1987 | Wilkinson | 272/70 |
| 4,715,296 | 12/1987 | Wilkinson | 108/16 |
| 4,991,325 | 2/1991 | Teduschi | 248/188 X |

FOREIGN PATENT DOCUMENTS

| | | | |
|---|---|---|---|
| 446381 | 7/1927 | Fed. Rep. of Germany . | |
| 458943 | 4/1928 | Fed. Rep. of Germany . | |
| 3523631 | 9/1989 | Fed. Rep. of Germany . | |
| 2611508 | 9/1988 | France . | |
| 179316 | 5/1922 | United Kingdom | 108/43 |

*Primary Examiner*—Gene Mancene
*Assistant Examiner*—L. Thomas
*Attorney, Agent, or Firm*—Connolly & Hutz

[57] ABSTRACT

An exercise step/bench for aerobic climbing and dance includes a base in the form of a horizontal platform having a downwardly and outwardly extending apron disposed at an angle greater than 0° and less than 90°. A leg is mounted against the apron at each corner of the platform. The leg is movable from an active position where it extends downwardly beyond the apron to a stored condition where it is mounted against or in the base within the periphery of the apron.

35 Claims, 4 Drawing Sheets

PORTABLE, ADJUSTABLE EXERCISE STEP/BENCH

CROSS REFERENCE TO RELATED APPLICATION

This application is a continuation-in-part of Ser. No. 533,004, filed June 4, 1990, now abandoned.

BACKGROUND OF INVENTION

Various devices exist for use in an aerobic exercise program. One type of device which has met with great success is a bench or step for aerobic step climbing. For example, I have developed a form of single step climbing during which the user would repeatedly step up and down from a single step. An important feature for making the device capable for widespread appeal to permit it to be customized to the needs of the particular user in height adjustability. In my U.S. Pat. No. ,340,218 I disclose one manner of achieving this height adjustability. Other later patents of mine disclose useful variations for accomplishing that result.

SUMMARY OF INVENTION

An object of this invention is to provide an exercise device for simulating climbing which is compact and lightweight and capable of being conveniently stored and transported.

A further object of this invention is to provide such a device which may offer a wide variety of incremental heights, that are easily and quickly adjustable, to accommodate the needs of the particular use.

A further object of this invention is to provide an unobstructed platform surface so that the user can safely step on and off in any direction.

A still further object is to provide such a device which may be mass produced inexpensively in a simple design.

A yet further object of this invention is to provide such a device which may be used as an elevated platform for warmup exercises.

In accordance with this invention, the exercise device for simulating climbing includes a base which is in the form of a horizontal platform having a downwardly and outwardly extending peripheral apron. The apron is disposed at an angle of from greater than 0° to less than 90° and preferably 20° from the platform so as to conveniently permit the user to step on and off the platform from any direction while providing the necessary stability for the platform. Height adjustment is achieved by a leg mounted in each corner of the platform, preferably against the apron so that the leg is disposed at the same angle as the apron. Each leg itself may be adjustable in its length to provide a certain degree of incremental height adjustment. Additionally, interchangeable legs of different lengths may be used to provide for the variation in height.

In a preferred practice of this invention, the legs are detachably mounted to guides at the corners of the base member. The guides may be in the form of tracks, grooves, channels, holes or post/holes. During the stored condition the legs may be removed and mounted to the base member itself. In an alternative form of this invention the legs may be hinged to the base member at the corners to be movable to and from an active position where the legs support the base member and a stored condition where the legs are hinged into contact with the lower surface of the platform.

THE DRAWINGS

DETAILED DESCRIPTION

Figure 2:
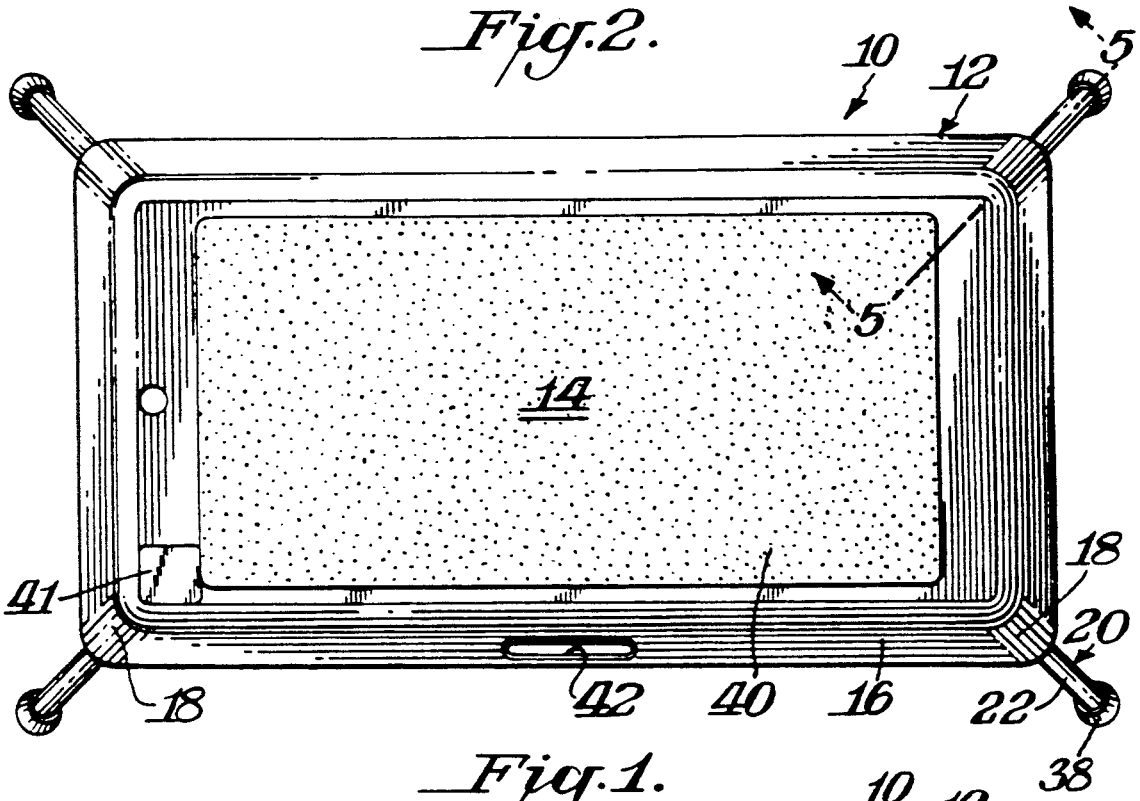
FIG. 2 is a top plan view of the exercise device shown in FIG. 1.
Figure 1:
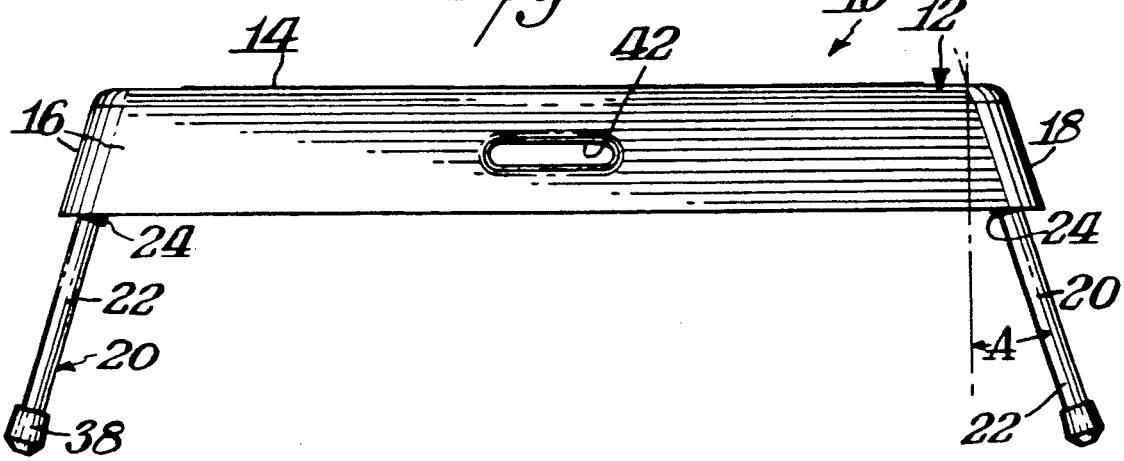
FIG. 1 is a side elevation view partly broken away of an exercise device in accordance with this invention.
Figure 3:
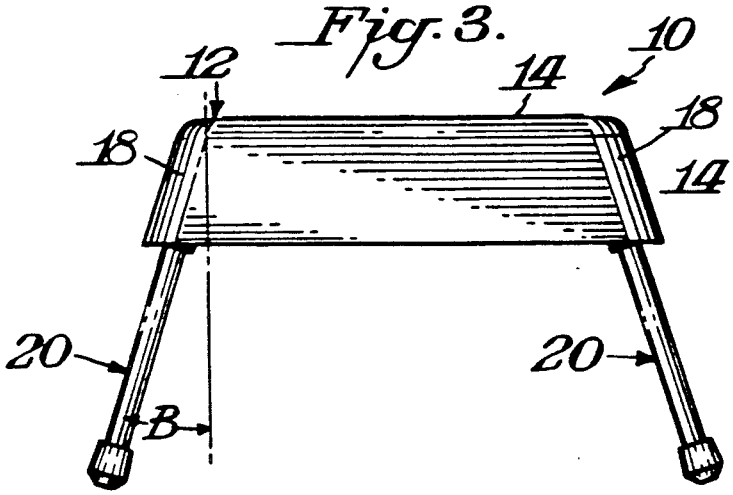
FIG. 3 is an end elevation view of the exercise device shown in FIGS. 1–2.

FIGS. 1–4 illustrate an exercise device 10 for simulating climbing. Exercise device 10 is particularly constructed to be used for single step climbing and aerobic exercise programs wherein the user will repeatedly step onto and off from a base 12 which functions as a step or bench. Base 12 includes a horizontal platform 14 having a pair of end walls interconnected by a pair of side walls. A downwardly and outwardly extending apron 16 is connected to the edge of the end and side walls at an angle with respect to horizontal platform 1. As illustrated, each corner 18 of apron 16 is of rounded configuration to eliminate sharp edges. A 20 is provided at each corner to elevate platform 14. Each leg 20 would be disposed at the same angle that apron 16 is inclined. For example, as shown in FIG. 1 leg 20 (and apron 16) is at an angle A with respect to the side wall of platform 14. FIG. 3 shows leg 20 to be at an angle B with respect to the end wall of platform 1. Angles A and B are greater than 0° and less than 90° so as to be non-horizontal and non-vertical. Preferably both A and B are between 10° and 30° and most preferably about 20°.

The invention may be practiced by having the legs hinged to base 12 so as to be moved from an active supporting position to an inactive stored condition. Alternatively, the legs may be completely detachable to be selectively moved to the two positions. Additionally, in the preferred practice of this invention, the effective length of each leg is adjustable to provide the ability to vary the height of platform 1.

Figure 7:
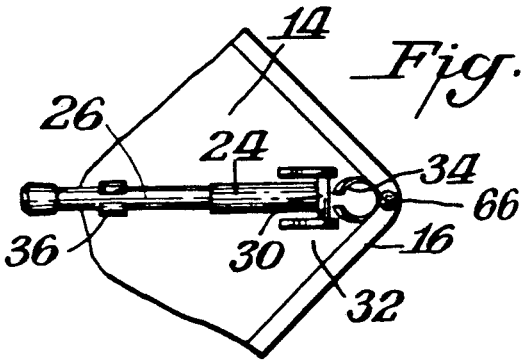
FIG. 7 is a bottom plan view of the device shown in FIG. 5.

In the embodiment of the invention illustrated in FIGS. 1–4 legs 20 are in the form of an inner tube 22 telescopically mounted in an outer tube 2. Outer tube 24 includes a series of holes 26. See for example, FIG. 5. Inner tube 22 would have a spring loaded pin 28 disposed for engagement in a selective hole. Holes 26 are spaced apart to provide, for example, two inch incremental height adjustment of platform 1. A mounting bracket 30 is provided at each corner 18 of base 12. Pivot shaft 32 is located in correspondingly in mounting bracket 30 to permit each leg 20 to pivot from its support position shown in solid in FIG. 5 to its stored condition shown in phantom in FIG. 5 and shown in solid in FIG. 7. Snap clips 3 are provided on apron 16 to hold each leg 20 in its support or active position. Similarly, snap clips 36 are provided on the underside of platform 1 to hold the legs 20 in their stored condition. Each leg 20 rotates about its axis a distance greater than 90° and preferably 110° to and from its stored and active positions.

As also illustrated a foot 38 is mounted on each leg 20 by being telescoped over inner tube 22. If desired foot 38 may be molded integrally with leg 20. Foot 38 serves the multiple functions of adding additional height to platform 14 and also by making foot 38 of a non-slip material the device 10 is less likely to slide or slip during the exercise program. Further because foot 38 is wider than leg 20, foot 38 also provides added stability. Similarly, a non-slip material 40 is provided on the upper surface of platform 14 to reduce the possibility of the user slipping when stepping up and down from platform 14. Alternatively, a non-slip surface may be provided by molding a non-slip design on the top surface of platform 14.

Indentations 41 may be molded at some or all of the corners of the upper surface of platform 14. Indentations 41 would function as entitlements to permit advertising bearing inserts to be mounted in indentation 41. The invention may be practiced with indentations 41 being in any exposed surface of base 12, including apron 16. Preferably each advertising insert would be flush with that surface of base 12.

Figure 4:
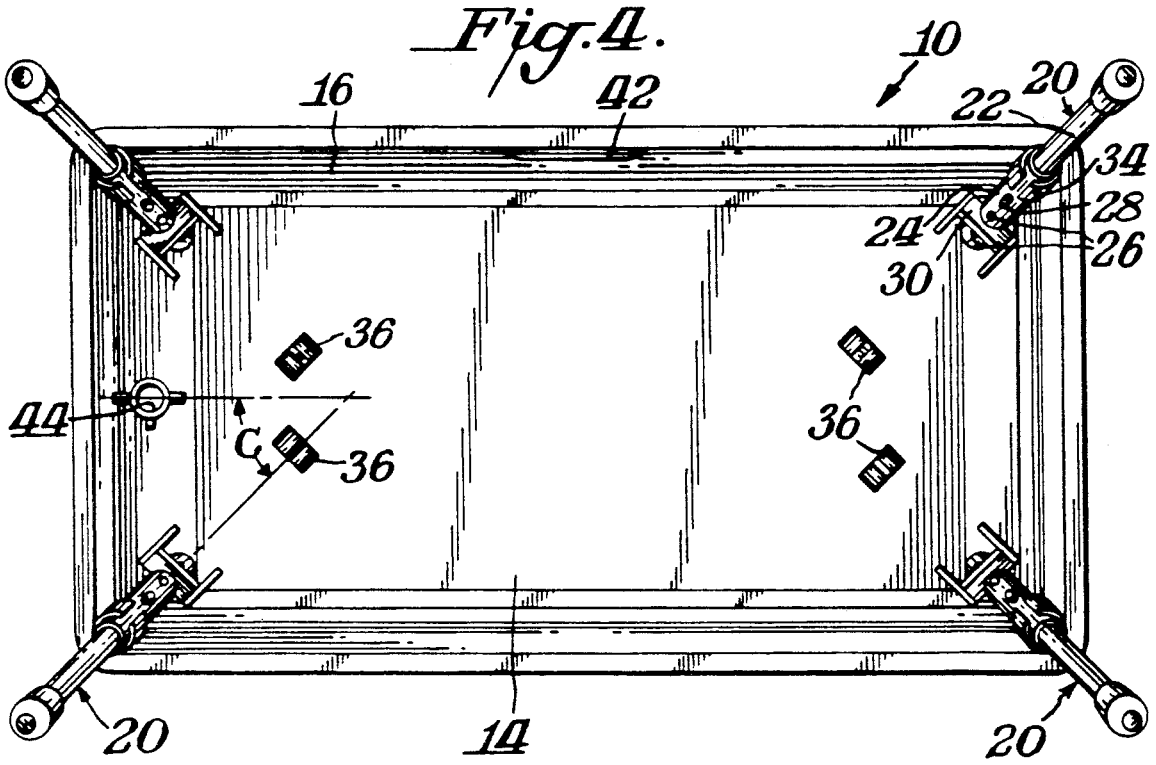
FIG. 4 is a bottom plan view of the exercise device shown in FIGS. 1–3.

Not only does each leg 20 extend downwardly at an angle of A and B in the elevation view, but also as shown in FIG. 4 each leg is at an angle C in the plan view with respect to the respective side and end walls of platform 14. Angle C is greater than 0° and less than 90° and is preferably 45°.

As also shown, for example, in FIGS. 1 and 2 a slot 42 is provided in one portion of apron 16 to act as a convenient handle for carrying the device, particularly when legs 20 are mounted in the stored condition within the periphery of apron 16 against the underside of platform 14. Alternatively, a carrying strap or handle may be utilized instead of slot 42.

Figure 8:
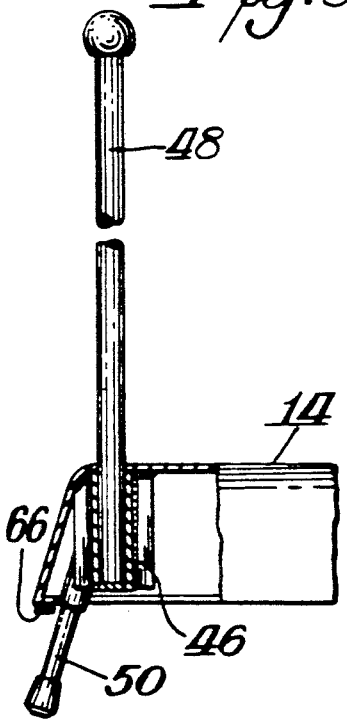
FIG. 8 is a side elevation view party broken away of a portion of the device shown in FIGS. 1–4 and further illustrating a support post.

FIGS. 1, 4 and particularly FIG. 8 illustrate a further feature of this invention wherein an opening 44 is provided in platform 14. A tubular sleeve 46 is secured against opening 44 as best shown in FIG. 8. Sleeve 46 functions to hold a steady post 8 mounted therein so that the user would have something to hold while performing the exercise. It is emphasized, however, that device 10 generally presents an unobstructed platform to facilitate the user stepping up and down from platform 1 in any direction from either end or either side of platform 1. Thus, steady post 48 is an optional feature which may be completely omitted. Where steady post 48 is included it is preferred that only a single such member be provided.

If desired a steady post could be mounted to base 12 by means of an external bracket secured generally at the juncture of apron 16 and an end edge of platform 14 rather than having the hole 44 and sleeve 46.

Figure 5A:
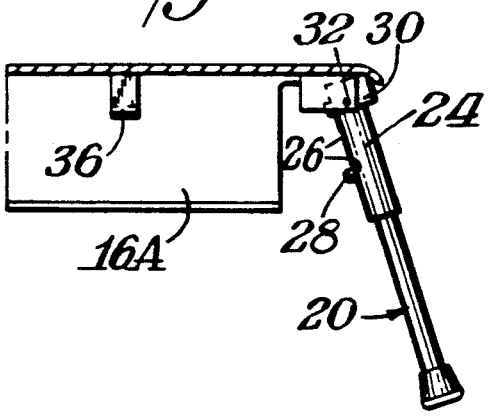
FIG. 5A is a view similar to FIG. 5 of a modified device in this invention.
Figure 6:
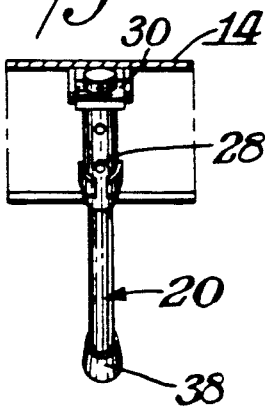
FIG. 6 is an end elevation view of the device shown in FIG. 5.
Figure 5:
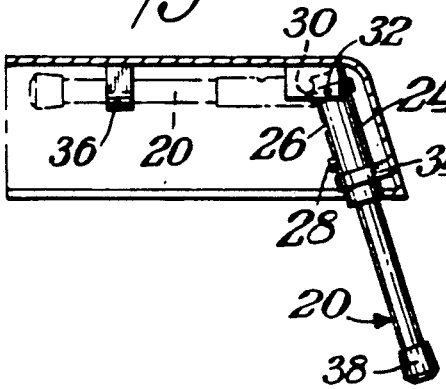
FIG. 5 is a cross-sectional view taken through FIG. 2 along the line 5—5.

In the preferred practice of this invention apron 16 is a continuous apron or skirt which extends completely around the periphery of platform 1. The invention, however, may be practiced by having open areas in apron 16A such as at the corners where the legs 20 would be located, as shown in FIG. 5A. In this embodiment the bracket 30 could abut against the underside of the platform to limit the outward pivoting of legs 20. Since the lower or remote edge of the extensions which form apron 16A would function as the support in the lowest position of the platform, a non-slip gasket could be mounted on the remote edge. Where there is an open area at each corner, the result would be that apron 16A would comprise four spaced extensions acting as fixed legs in the lowest position of the platform. The invention may also be practiced with the extensions or fixed legs at any spaced locations including the corners with the pivoted legs inwardly thereof.

Figure 9:
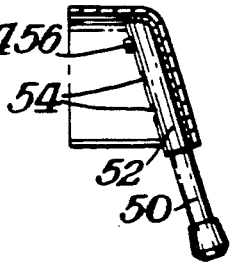
FIG. 9 is a side elevation view of a detachable leg for a device in accordance with this invention.
Figure 10:
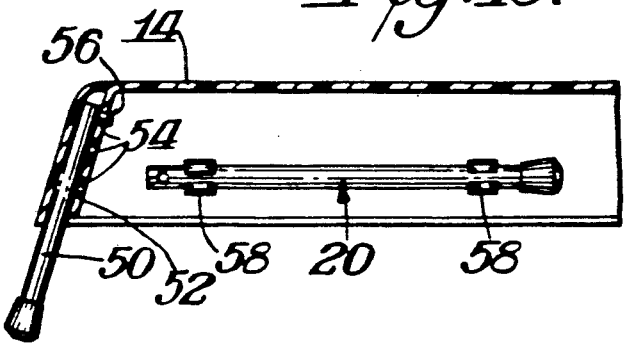
FIG. 10 is a side elevation view in section of the embodiment shown in FIG. 9.

Although the embodiment of FIGS. 1–7 illustrate legs 20 to be hinged, in a particularly advantageous practice of this invention, legs 50 are provided which are completely detachably secured to base 12 as illustrated in FIGS. 9–10. In this embodiment, legs 50 are held by guides 52 integrally formed with base 12. For example, guides 52 may be in the form of channels, grooves, brackets, tracks, post/holes or pockets integrally molded during the same operation in which base 12 is molded. A series of spaced holes 54 would be provided in these guides 52 for reception of spring pin 56 on leg 50 so as to vary the amount of extension of leg 50 from guide 52 which in turn would control the height of platform 14. Holes 54 preferably provide two inch height adjustment.

As shown in FIG. 10 mounting devices such as spring clamps 58 are secured to the inner surface of apron 16 so that legs 50 may be mounted to base 12 during the stored condition of the legs. Similarly, such spring clamps 58 may also be used to store legs of one size while legs of another size are mounted in guides 52 during the active or support condition of the legs. The stored legs may be mounted to the underside of platform 14 or the inside of apron 16. If desired clamps or grooves could be molded to apron 16 to store the legs.

Figure 11:
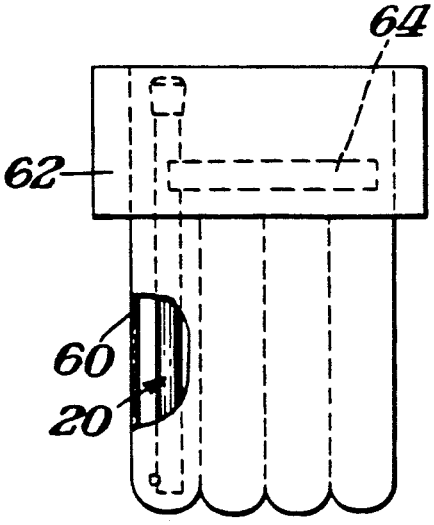
FIG. 11 is a top plan view partly broken away showing a pouch for holding sets of legs usable with the device of this invention.

FIG. 11 illustrates a further feature of this invention wherein a storage pouch 60 is provided of a size and shape to package or hold sets of legs 50. The storage pouch could include for example an openable flap 62 having a hook and loop material, such as sold under the trademark VELCRO, strip 64 for selective opening and closing of the fap to provide or prevent access to the legs stored in pouch 60. Pouch 60 could be placed within the periphery of apron 16 during the transport and storage of device 10.

Legs 50 may be of singular tubular construction or legs 50 may also take the same form as legs 20 to provide added length adjustment. In this respect, legs 50 could be formed as an inner tube telescopically mounted in an outer tube.

A further feature of this invention is the provision of spring members in the legs 20 or 50 to lessen the climbing impact when the user steps onto platform 14. The spring members would also provide energy return to produce a bounce effect.

In the preferred practice of this invention apron 16 would be dimensioned so that when apron 16 is placed directly on the floor platform 1 would be disposed 4 inches above the floor. Apron 14 may be provided with an edge made of a non-slip material such as rubber to facilitate the use of base 12 being placed directly on the floor where the exercise program would have the user step at a height of 4 inches. Apron 16 may, for example, have rubber grommets 66 at the corners as shown in FIG. 8. Device 10 is so constructed that the height of platform 14 above the floor could be incrementally increased by two inch increments from four inches to 14 inches. For example, for beginners an exercise program might require a height in the range of 4–10 inches whereas an advanced program might require a height of 10–14 inches. Accordingly, the minimum height of four inches could be achieved by mounting base 12 directly on the floor without the use of any legs or feet. Feet 38 could be dimensioned to add, for example, one inch elevation. In the preferred practice of this invention two sets of legs having differing lengths would be provided. For example, the shorter set of legs could be utilized for the beginner program and the longer set of legs for the advanced program. The 2 inch increments could be achieved by providing extendability of each set of legs in 2 inch increments an then shifting from one set of legs to another when a greater or lesser height is required. In the preferred practice of this invention, platform 14 would be dimensioned longer and wider than a conventional stool and would, for example, be $28 \times 14$ inches with a height of 4 inches because of its angled apron 16.

Platform 14 could be given added strength by forming ribs on its underside.

If desired, each foot 38 could be mounted to its leg in the same manner that the leg is mounted to the base by having adjustable telescopic positioning of each foot over its respective leg. This would likewise provide for additional height flexibility.

In use the exercise program could thus be performed by using the base alone or by using the base with short legs or by using the base with short extended legs or by using the base with long legs or by using the base with long extended legs or by additionally providing feet including adjustably mounted feet on the legs.

Device 10 may be formed in any suitable manner. In the preferred practice of the invention device 10 is made from a plastic material which is injected or blow molded. Device 10 may however be stamped from a metal material. An advantage of the tapered apron 16 is that a plurality of such devices may be stacked within each other.

Figure 12:
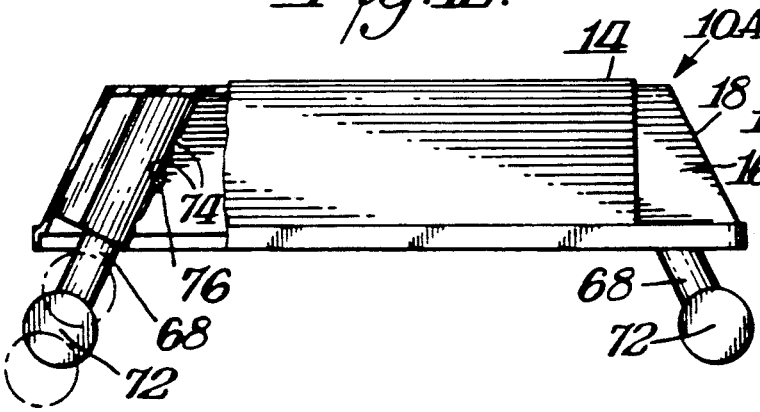
FIG. 12 is a side elevation view partly in section of an alternative device in accordance with this invention.
Figure 13:
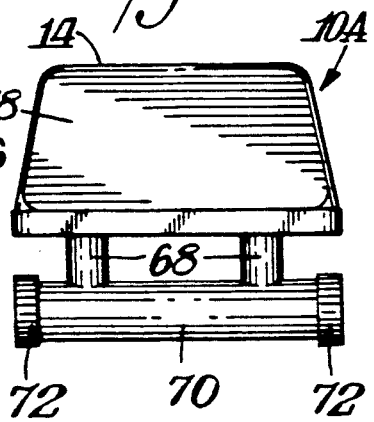
FIG. 13 is an end elevation view of the device of FIG. 12.

FIGS. 12–13 show a further embodiment wherein device 10A includes a pair of legs 68,68 at each end of base 12 integrally connected to each other by a single foot 70 having non-slip end caps 72,72. This embodiment illustrates that the legs may but need not be secured at the corners of base 12. As shown in FIG. 13 the legs 68,68 are mounted inwardly of corners 18,18. The U-shaped unit comprising legs 68,68 and foot 70 may be mounted in any suitable manner. As shown in FIG. 12 each leg 68 is inserted into a channel 74 integral with apron or skirt 16 and is selectively held in position by spring pin 76 engaged in one of a selected number of holes in channel 74.

Figure 16:
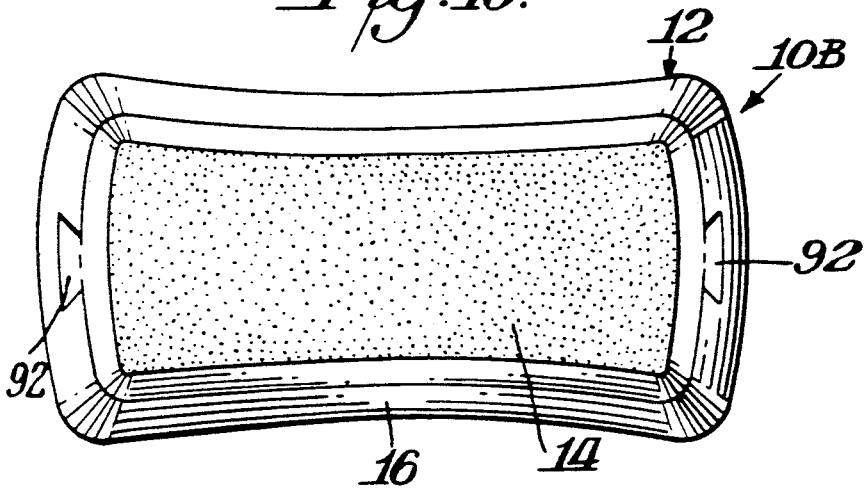
FIG. 16 is a top plan view of the device of FIGS. 14–15.
Figure 14:
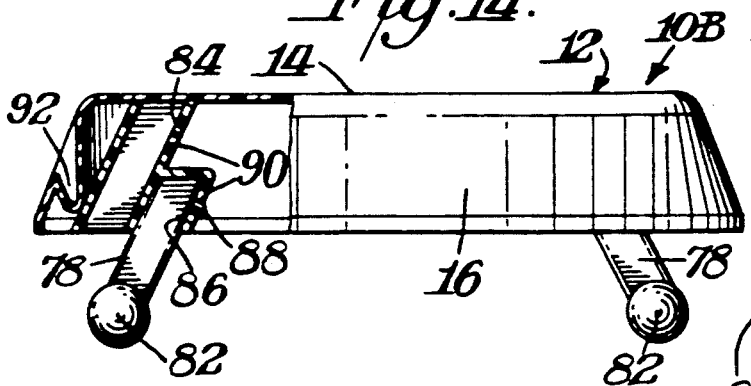
FIG. 14 is a side elevation view partly in section of a further alternative device in accordance with this invention.
Figure 15:
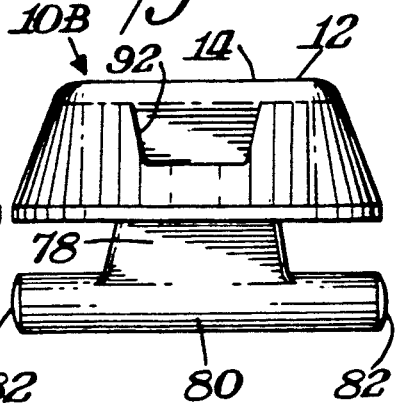
FIG. 15 is an end elevation view of the device of FIG. 14.

FIGS. 14–16 illustrate yet other variations of this invention. As shown therein with device 10B a single wide leg 78 is provided at each end of base 12. An elongated foot 80 is integral with leg 78. End caps made of non-slip material may be mounted on foot 78 or the ends 82 may simply be rounded.

FIG. 14 illustrates a particularly advantageous manner of mounting the legs to provide height adjustability. Instead of having a series of holes for adjustability at least two side by side slots or channels 84,86 are integrally formed on apron 16. The channels are made of different lengths. For example, when leg 78 is inserted completely into long channel 84, it will elevate platform another two inches. When, however, leg 78 is completely inserted into short channel 86, platform 14 will be elevated four inches. Leg 78 may be locked into a respective channel in any suitable manner such as by spring pin 88 on leg 78 snapping into a hole 90 in the channel wall. This manner of height adjustability may, of course, be utilized in the other embodiments.

Other variations illustrated in FIGS. 14–16 include the provision of indents 92 in the opposite ends of apron 16. Indents 92 may be used to grasp base 12 when carrying the device. As illustrated in FIG. 16, platform 14 need not be rectangularly shaped. As shown the side walls of base 12 are inwardly bowed. If desired the ends and/or sides of base 12 may be inwardly or outwardly bowed.

The dimensioning of the platform, particularly with no above surface frame so that it is unobstructed on all four sides is particularly advantageous for aerobic routines. The invention can be practiced by having, for example, a single base with two sets of extensions or if desired by having two bases each with its own extensions for legs.

As can be appreciated, device 10 thus provides an exercise device wherein the height can be readily varied in a number of different manners. Moreover, by being able to store the legs within the periphery of the apron the resultant device is compact, lightweight and space saving.

What is claimed is:

1. An exercise device for use in aerobic step climbing routines/programs comprising a rigid base, said base consisting of an integral one piece unit including a horizontal platform having opposite ends and intermediate sides with a downwardly and outwardly extending apron extending from each of said ends and sides, a corner where each of said ends is joined to its adjacent side, said apron being disposed at an elevation and plan view angle from greater than 0° to less than 90° with respect to said platform, a leg mounted to said base at each of said corners, each of said legs being movable from an active position to a stored condition, each of said legs being disposed against said apron at said angle and extending downwardly beyond said apron when said leg is in said active position, and each of said legs being mounted against said base within the periphery of said apron when said leg is in said stored condition.

2. The device of claim 1 wherein each of said legs is adjustable in its length.

3. The device of claim 2 wherein each of said legs comprises an inner tube telescopically mounted within an outer tube, and incremental locking means connecting said inner tube to said outer tube to control the effective length of said leg.

4. The device of claim 2 including a foot on each of said legs made from a non-slip material.

5. The device of claim 4 including a non-skid surface on said platform.

6. The device of claim 2 wherein each of said legs is hinged to said base to be movable to and from said active position and said stored condition.

7. The device of claim 6 wherein each of said legs is rotatable over a range of 110°.

8. The device of claim 7 including mounting means on the under surface of said platform for maintaining each of said legs in its stored condition when each of said legs is hinged from its active position in contact with said apron to its stored condition in contact with the under surface of said platform.

9. The device of claim 2 wherein said apron is integral and extends completely around the periphery of said platform to form a continuous apron having four rounded corners, a guide mounted at each of said corners, and each of said legs being disposed in a respective one of said guides.

10. The device of claim 9 wherein each of said legs is adjustably mounted in its respective guide.

11. The device of claim 10 wherein each of said guides is integral with said apron, a plurality of spaced holes located in each of said guides, and each of said legs having a spring pin disposed for selective engagement in a respective one of said holes in its guide to control the amount that each of said legs extends below said apron.

12. The device of claim 11 including said base having mounting means for holding said legs in said stored condition.

13. The device of claim 12 wherein said mounting means are mounted to said apron.

14. An exercise device for use in aerobic step climbing routines/programs comprising a base, said base consisting of a horizontal platform having opposite ends and intermediate sides with a downwardly and outwardly extending apron extending from each of said ends and sides, a corner where each of said ends is joined to its adjacent side, said apron being disposed at an elevation and plan view angle from greater than 0° to less than 90° with respect to said platform, a leg mounted to said base at each of said corners, each of said legs being movable from an active position to a stored condition, each of said legs being disposed against said apron at said angle and extending downwardly beyond said apron when said leg is in said active position, each of said legs being mounted against said base within the periphery of said apron when said leg is in said stored condition, each of said legs being adjustable in its length, said apron being integral and extending completely around the periphery of said platform to form a continuous apron having four rounded corners, a guide mounted at each of said corners, each of said legs being disposed in a respective one of said guides, each of said legs being adjustably mounted in its respective guide, each of said guides being integral with said apron, a plurality of spaced holes located in each of said guides, each of said legs having a spring pin disposed for selective engagement in a respective one of said holes in its guide to control the amount that each of said legs extends below said apron, a foot on each of said legs, said foot being made of a non-skid material, said base having mounting means for holding said legs in said stored condition, said mounting means being mounted to said apron, said legs including two sets of legs, one set of said legs being longer than the other set of said legs, and one of said sets of legs being held by said mounting means when the other of said sets of legs is in the active position.

15. The device of claim 14 wherein said device is dimensioned to dispose said platform selectively at a plurality of heights in the range of 4 to 14 inches.

16. The device of claim 15 wherein said elevation angle is between 10° and 30°, and said platform being free of above surface obstructions.

17. The device of claim 11 including a foot on each of said legs integral with its leg.

18. The device of claim 1 including a steady post detachably mounted in a vertical position to said platform.

19. The device of claim 1 including handle means on said base to facilitate the carrying of said device.

20. The device of claim 19 wherein said handle means comprises a slot in said apron.

21. An exercise device for use in aerobic step climbing routines/programs comprising a base, said base consisting of a horizontal platform having opposite ends and intermediate sides with a downwardly and outwardly extending apron extending from each of said ends and sides, a corner where each of said ends is joined to its adjacent side, said apron being disposed at an elevation and plan view angle from greater than 0° to less than 90° with respect to said platform, a leg mounted to said base at each of said corners, each of said legs being movable from an active position to a stored condition, each of said legs being disposed against said apron at said angle and extending downwardly beyond said apron when said leg is in said active position, each of said legs being mounted against said base within the periphery of said apron when said leg is in said stored condition, said legs comprising two sets of legs, one set of said legs being longer than the other set of said legs, and mounting means for mounting one of said sets of legs to or in said base while the other of said sets of legs is in said active position.

22. The device of claim 21 including a pouch and one of said sets of legs being located in said pouch with said pouch mounted within the periphery of said apron.

23. The device of claim 1 including a pouch, and said legs being disposed in said pouch with said pouch mounted within the periphery of said apron when said legs are in said stored condition.

24. The device of claim 1 including at least one indentation in an exposed surface of said base for holding an advertising insert.

25. The device of claim 1 wherein said elevation angle comprises a first angle with respect to an end of said base and a second angle with respect to said intermediate side, and each of said first and second second angle being between 10° and 30°.

26. The device of claim 25 wherein each of said first and second second angle is about 20°, and said plan view angle being about 45°.

27. An exercise device for use in aerobic step climbing routines/programs comprising a base, said base consisting of a horizontal platform having an unbroken generally planar upper surface and having opposite ends with straight parallel upper edges and intermediate sides with straight parallel upper edges, said upper edges of said platform being rounded, said upper surface being unobstructed and free of any vertically extending members whereby said upper surface functions as a user support surface and a user may easily step onto and off of said upper surface, a plurality of downwardly disposed extensions connected to said platform at a plurality of spaced locations said extensions comprising fixed support members having remote ends disposed remote from said upper surface whereby said platform is elevated to a first height stabilized by said extensions when said remote ends of said extensions are placed directly on a flat planar support surface, and at least two legs, each of said legs being secured to said base remote from its other leg, each of said legs being of a length longer than the length of said extensions, each of said legs being hinged to said base to be movable to and from an active position and a stored condition, each of said legs being in said active position when said leg is pivoted away from said base whereby said legs extend beyond said remote ends of said extensions to elevate said platform to a second height hinged than said first height, each of said legs being in said stored condition when said no further from said platform than said remote ends of said extensions when said extensions are in direct contact with said flat planar support surface whereby said extensions support and elevate said platform when said legs are in their stored condition, and said spaced extensions having a plurality of open areas therebetween.

28. The device of claim 27 wherein said legs are secured to said base by mounting brackets.

29. The device of claim 28 wherein said platform has an upper surface, and a non-slip material being on said upper surface.

30. The device of claim 27 wherein said extensions comprise four spaced extensions.

31. The device of claim 27 wherein each of said legs has a remote end remote from said base, and said remote end of each of said legs extending outwardly beyond the periphery of said base when said legs are in their active position.

32. The device of claim 31 wherein each of said remote ends of said legs is spaced from the underside of said platform when said legs are in said stored condition.

33. The device of claim 32 wherein each of said legs is movable in said open areas between said extension.

34. The device of claim 33 wherein said platform has rounded corners, and each of said legs extending outwardly away from said platform at an angle greater than 90° when said legs are in said active position.

35. The device of claim 34 wherein said upper surface of said platform has an advertising indentation at one of its corners.

* * * * *